US012310477B2

(12) United States Patent
Lim

(10) Patent No.: US 12,310,477 B2
(45) Date of Patent: May 27, 2025

(54) SHOPPING BAG

(71) Applicant: Sungmook Lim, Seongnam-si (KR)

(72) Inventor: Sungmook Lim, Seongnam-si (KR)

( * ) Notice: Subject to any disclaimer, the term of this patent is extended or adjusted under 35 U.S.C. 154(b) by 56 days.

(21) Appl. No.: 18/014,023

(22) PCT Filed: Jan. 17, 2022

(86) PCT No.: PCT/KR2022/000790

§ 371 (c)(1),
(2) Date: Dec. 30, 2022

(87) PCT Pub. No.: WO2022/164101

PCT Pub. Date: Aug. 4, 2022

(65) Prior Publication Data

US 2023/0284759 A1 Sep. 14, 2023

(30) Foreign Application Priority Data

Jan. 28, 2021 (KR) ..... 10-2021-0012275

(51) Int. Cl.
*A45C 3/04* (2006.01)
*B65D 30/06* (2006.01)

(52) U.S. Cl.
CPC ..... *A45C 3/045* (2013.01); *B65D 29/04* (2013.01)

(58) Field of Classification Search
CPC ..... A45C 3/045; B65D 29/04
USPC ..... 383/6, 117
See application file for complete search history.

(56) References Cited

U.S. PATENT DOCUMENTS 9,301,594 B1 * 4/2016 Scior ..... A45C 3/045

FOREIGN PATENT DOCUMENTS

| | | | | |
|---|---|---|---|---|
| CH | 350767 A | * | 12/1960 | |
| DE | 3539203 A1 | * | 5/1987 | |
| DE | 202018105327 U1 | * | 10/2019 | |
| GB | 1223027 A | * | 2/1971 | ..... B65D 29/04 |
| JP | H7-35369 U | | 6/1995 | |
| JP | H7-172459 A | | 7/1995 | |
| JP | 2011-189943 A | | 9/2011 | |
| JP | 2020-199641 A | | 12/2020 | |
| KR | 20-2020-0001799 U | | 8/2020 | |

OTHER PUBLICATIONS

Machine translation of DE-202018105327-U1 (Year: 2019).*

(Continued)

*Primary Examiner* — Jes F Pascua
(74) *Attorney, Agent, or Firm* — Hauptman Ham, LLP

(57) ABSTRACT

Provided is a shopping bag adopting a unique design structure, so that a user's will to re-use the shopping bag can be strengthened and the shopping bag is easy to be processed. The shopping bag entirely has an elliptical structure and comprises: a central portion on which an object is placed; a peripheral portion which surrounds the central portion and has various cut patterns formed therein; and a pair of handle portions which are symmetrically formed at both sides of the edge of the peripheral portion, wherein the specially designed cut patterns are adopted in order to relieve asymmetrical stress caused by the elliptical structure and stress concentration due to the cut patterns.

5 Claims, 5 Drawing Sheets

(56) References Cited

OTHER PUBLICATIONS

International Search Report issued on May 9, 2022, for corresponding International Patent Application No. PCT/KR2022/000790, along with an English translation (5 pages).
Written Opinion issued on May 9, 2022, for corresponding International Patent Application No. PCT/KR2022/000790 (4 pages).

* cited by examiner

SHOPPING BAG

CROSS REFERENCE TO RELATED APPLICATION

The present application is a national stage filing under 35 U.S.C § 371 of PCT application number PCT/KR2022/000790 filed on Jan. 17, 2022, which is based upon and claims the benefit of priority to Korean Patent Application No. 10-2021-0012275, filed on Jan. 28, 2021, in the Korean Intellectual Property Office. All of the aforementioned applications are incorporated herein by reference in their entireties.

TECHNICAL FIELD

The present invention relates to a shopping bag, and more particularly, to a shopping bag adopting a design structure that is made by a single process without using an adhesive and maximizes stress distribution to prevent breakage.

BACKGROUND ART

In general, a shopping bag is required to carry purchased objects when purchasing household items or groceries at department stores, discount stores, or supermarkets. Typically, a shopping bag made of paper or vinyl is generally used. Since this typical shopping bag is not easily collected and recycled and has a monotonous design that is focused on function only due to a low manufacturing cost, a user does not have a will to re-use the shopping bag. Also, since most typical shopping bags are made of an opaque material, an object stored therein is not easily checked.

DISCLOSURE OF THE INVENTION

Technical Problem

The present invention provides a shopping bag which adopts a unique design structure to strengthen a user's will for re-use and is easily processed.

The object of the present invention is not limited to the aforesaid, but other objects not described herein will be clearly understood by those skilled in the art from descriptions below.

Technical Solution

According to an embodiment of the present invention, a shopping bag for storing an object includes: a central portion on which the object is disposed; a peripheral portion configured to surround the central portion; and a pair of handle portions symmetrically formed at both sides of an edge of the peripheral portion. Here, the edge of the peripheral portion has an elliptical shape, a plurality of elliptical virtual lines that are not in overlap with each other are provided in the peripheral portion, a plurality of cut patterns that are spaced apart from each other are formed on each of the elliptical virtual lines, and although the plurality of elliptical virtual lines have the same center, major axes of the plurality of elliptical virtual lines have different lengths, and minor axes of the plurality of elliptical virtual lines have different lengths. Also, a spaced space between the plurality of cut patterns formed on a predetermined elliptical virtual line is not in overlap with that between the plurality of cut patterns formed on an elliptical virtual line adjacent to the predetermined elliptical virtual line, each of a length of the cut pattern and a distance between two adjacent elliptical virtual lines gradually increases in a direction from the center to the edge, and the central portion, the peripheral portion, and the handle portions are formed on one flat material by Thomson processing.

Each elliptical virtual line may include the same number of cut patterns within a predetermined angle range in a random direction based on the center, and a length of each of the plurality of cut patterns formed on one elliptical virtual line may gradually decrease in a direction from a major axis to a minor axis.

An end of the cut pattern formed on an odd-numbered elliptical virtual line from the center may be disposed on a predetermined linear line passing through the center, and an end of the cut pattern formed on an even-numbered elliptical virtual line from the center may be disposed on a predetermined linear line passing through the center.

The handle portion may be adjacent to the major axis of the peripheral portion, and a connection portion configured to connect an inside of the handle portion and the edge of the peripheral portion may be rounded.

The flat material may be a spunbond olefin sheet made of high-density polyethylene.

Two predetermined adjacent elliptical virtual lines may have a distance therebetween greater in a direction of the major axis than in a direction of the minor axis.

A pair of hooks may be formed at the edge of the peripheral portion in the major axis, and after an object is stored in the shopping bag, the pair of hooks may be coupled to each other to prevent the stored object from falling out of the shopping bag.

Particularities of other embodiments are included in the detailed description and drawings.

Advantageous Effects

As described above, the shopping bag according to the present invention may include the cut pattern through which the object stored therein is checkable to create an aesthetic sense, thereby motivating the user to re-use the shopping bag repeatedly.

The shopping bag according to the present invention may have the elliptical structure as a whole and include the pair of handle portions formed on the both sides of the edge of the peripheral portion, particularly on the edge corresponding to the major axis of the elliptical structure, to prevent the object from falling out of the shopping bag when the user stores the object in the shopping bag and then carries the object while holding the handle portions.

The elliptical structure of the shopping bag and the position of the handle portion cause the asymmetric stress to be applied to the shopping bag by the weight of the object stored in the shopping bag. Also, the stress may be concentrated on the cut pattern formed on the shopping bag to cause the risk of breakage. For example, the risk of breakage may increase as the length of the cut pattern increases and as the distance between the cut patterns adjacent in the direction from the center to the edge decreases. The present invention adopts the following optimized cut pattern design structure capable of effectively distributing the stress in order to solve the risk of breakage and the stress concentration caused by the cut pattern and the asymmetrical stress caused by the elliptical structure of the shopping bag.

First, since the length of the cut pattern gradually increases in the direction from the center to the edge of the shopping bag, the cut pattern adjacent to the edge may be more vulnerable to the stress. The present invention is designed to compensate the above-described problem in such a manner that the cut pattern adjacent to the edge has the greater stress carrying capacity by increasing the distance between the elliptical virtual lines or the distance between the cut patterns formed thereon in the direction from the center to the edge of the shopping bag.

Second, the present invention is designed in such a manner that the distance between the two adjacent elliptical virtual lines is wider in the direction of the major axis than in the direction of the minor axis in order to relieve the stress from being concentrated by the handle portion formed around the major axis of the peripheral portion. As a result, since the distance between the cut patterns adjacent in the direction of the major axis is wider than that between the cut patterns adjacent in the direction of the minor axis, the peripheral portion has the stress carrying capacity greater in the direction of the major axis than in the direction of the minor axis to relieve the stress concentration caused by the handle portion.

Third, since the peripheral portion has the elliptical structure, the distance between the two adjacent elliptical virtual lines is narrower in the direction of the minor axis than in the direction of the major axis. Thus, the stress may be more concentrated in the direction of the minor axis in which the distance between the adjacent elliptical virtual lines is narrow. In order to compensate the above-described problem, the present invention provides the difference in length for each position of the cut patterns formed on one elliptical virtual line. That is, the present invention is designed in such a manner that the cut pattern adjacent to the direction of the minor axis has the high stress carrying capacity as the length of each of the plurality of cut patterns formed on the one elliptical virtual line gradually decreases in the direction from the major axis to the minor axis.

Fourth, the shopping bag according to the present invention may be manufactured by using the spunbond olefin sheet made of high-density polyethylene to have all the excellent properties of paper, a film, or a fabric, and particularly, eliminate the risk of breakage caused by the asymmetric stress and the cut pattern although manufactured with the small thickness.

MODE FOR CARRYING OUT THE INVENTION

Figure 1:
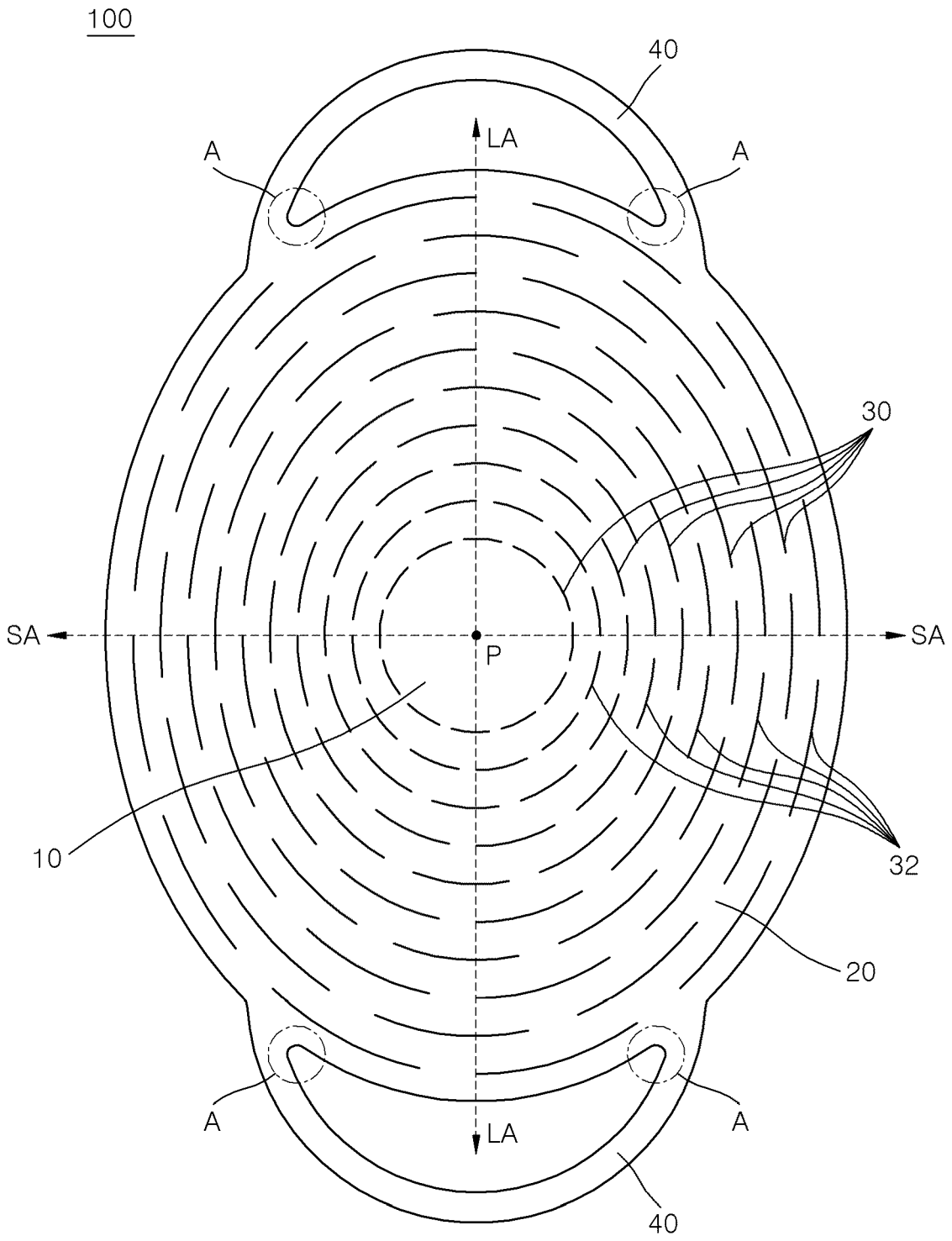
FIG. 1 is a front view illustrating a shopping bag according to an embodiment of the present invention.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims. Like reference numerals refer to like elements throughout.

Figure 2:
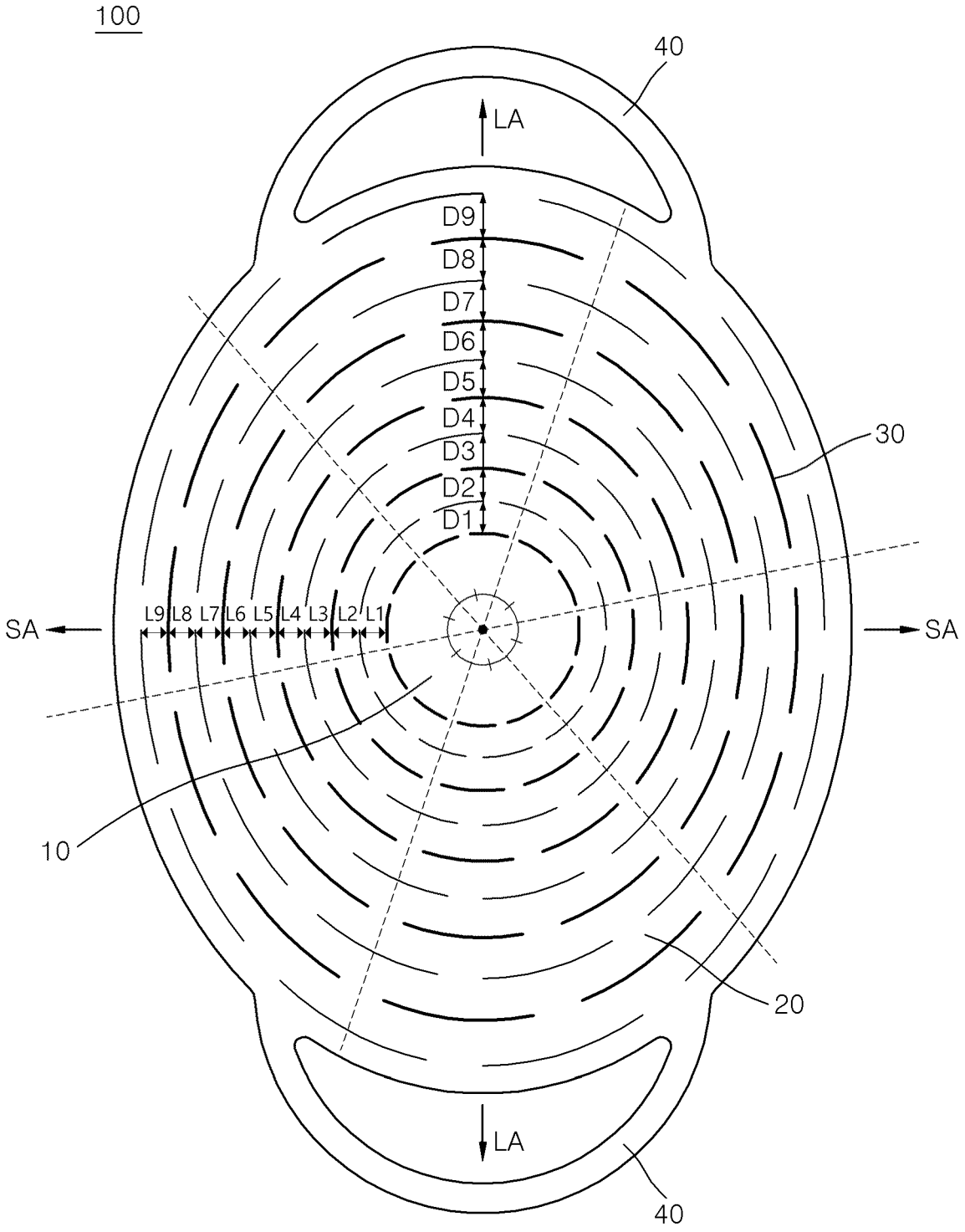
FIG. 2 is a view in which a first cut pattern is illustrated by a thick line in the shopping bag of FIG. 1.
Figure 3:
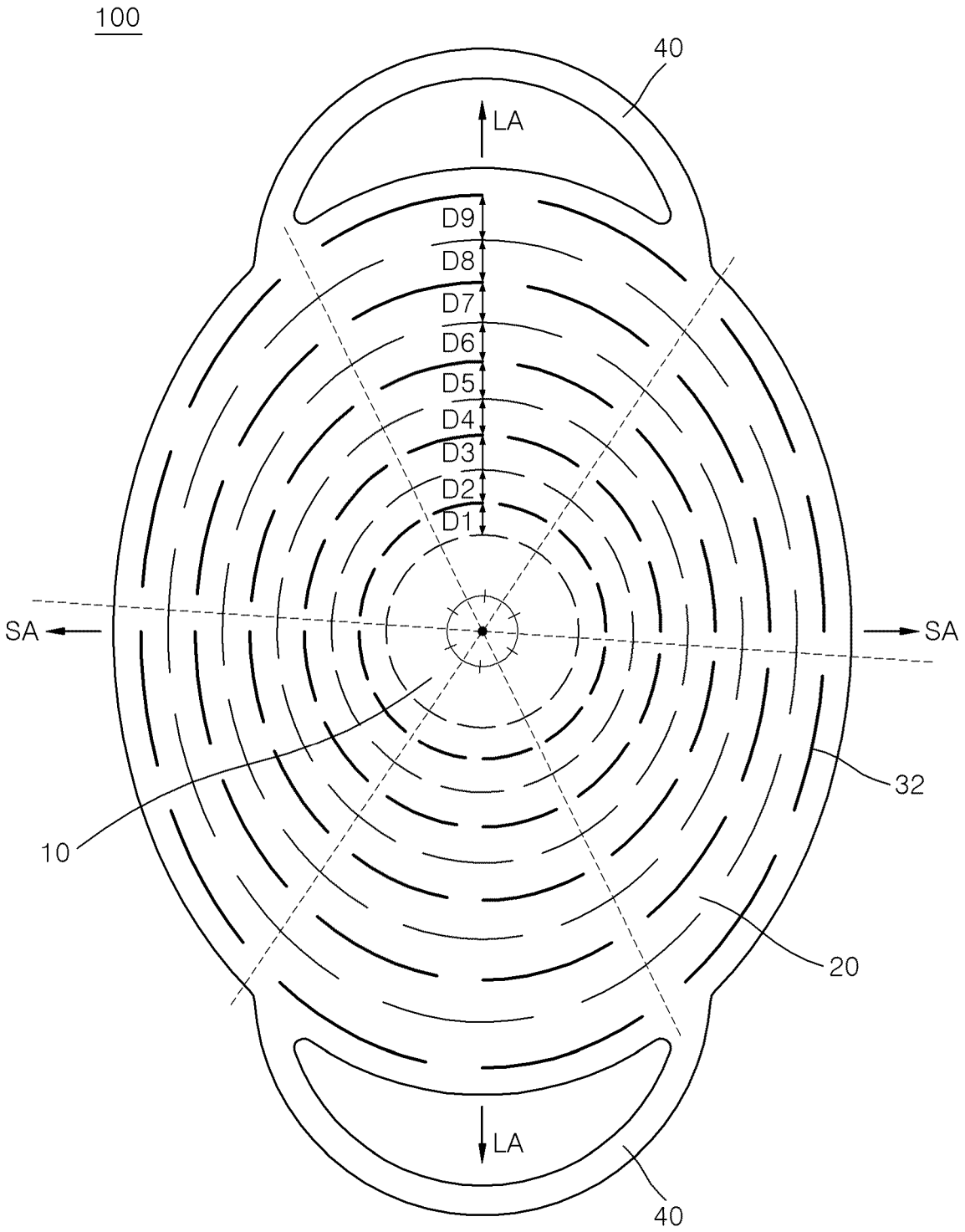
FIG. 3 is a view in which a second cut pattern is illustrated by a thick line in the shopping bag of FIG. 1.
Figure 4:
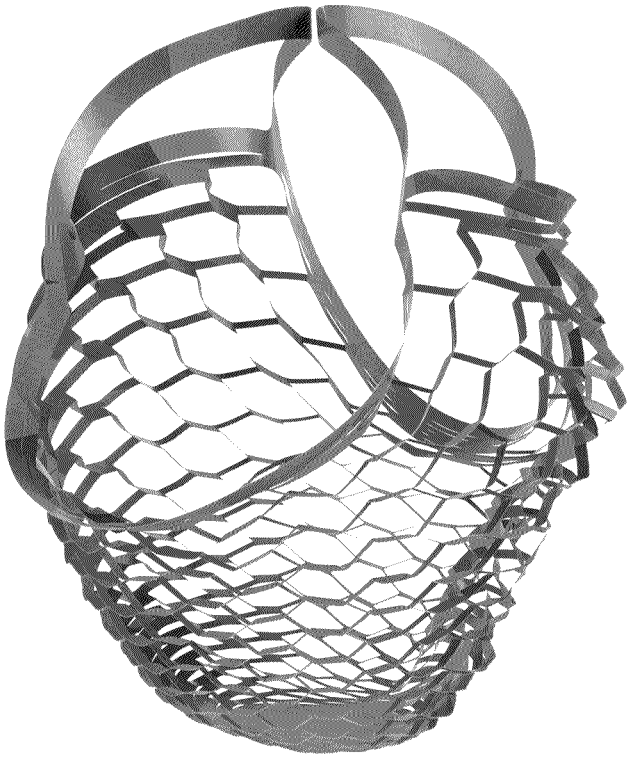
FIG. 4 is a real photograph of the shopping bag of FIG. 1.

Hereinafter, a shopping bag according to an embodiment of the present invention will be described with reference to FIGS. 1 to 4. FIG. 1 is a front view illustrating the shopping bag according to an embodiment of the present invention. FIG. 2 is a view in which a first cut pattern is illustrated by a thick line in the shopping bag of FIG. 1. FIG. 3 is a view in which a second cut pattern is illustrated by a thick line in the shopping bag of FIG. 1. FIG. 4 is a real photograph of the shopping bag of FIG. 1.

Referring to FIG. 1, a shopping bag 100 for storing an object through various configurations formed on one flat material according to the present invention includes a central portion 10 on which an object is disposed; a peripheral portion 20 which surrounds the central portion 10; and a pair of handle 40 portions which are symmetrically formed at both sides of an edge of the peripheral portion 20.

The central portion 10 that is an area on which the stored object is seated may have, e.g., a circular shape. However, the present invention is not limited thereto. For example, the central portion may have an elliptical shape, and one or more openings may be formed in the central portion.

The peripheral portion 20 is an area surrounding the central portion 10, and the edge of the peripheral portion 20 has an elliptical shape. In the peripheral portion 20, a plurality of elliptical virtual lines that are not in overlap with each other are provided, and a plurality of cut patterns 30 and 32 that are spaced apart from each other are formed on each of the elliptical virtual lines. Although the plurality of elliptical virtual lines have the same center P, major axes thereof have different lengths, and minor axes thereof have different lengths. That is, the plurality of elliptical virtual lines form concentric ellipses.

The handle portions 40 are formed symmetrically on the both sides of the edge of the peripheral portion 20, particularly on the both sides of the edge corresponding to a major axis LA of the peripheral portion 20. Since the shopping bag 100 has an elliptical structure as a whole, and the handle portions 40 are formed adjacent to the major axis LA of the peripheral portion 20, when a user stores an object in the shopping bag 100 and then holds the both handle portions 40 to carry the object, the object may be effectively prevented from falling out of the shopping bag 100. In order to relieve stress concentrated on the handle portion 40 due to the object stored in the shopping bag 100, a connection portion A connecting an inside of the handle portion 40 and the edge of the peripheral portion 20 may be rounded.

The central portion 10, the peripheral portion 20, and the handle portion 40 may be formed on one flat material by Thomson processing. Thomson processing refers to a processing method of using a wooden knife or the like to press a flat material such as paper and a fabric.

Hereinafter, referring to FIGS. 2 and 3, a plurality of elliptical virtual lines form concentric ellipses on the peripheral portion 20, a plurality of first cut patterns 30 are formed on odd-numbered elliptical virtual lines from the center P, and a plurality of second cut patterns 32 are formed on even-numbered elliptical virtual lines from the center P.

A spaced space between the plurality of cut patterns 30 and 32 formed on a predetermined elliptical virtual line may not overlap a spaced space between the plurality of cut patterns 30 and 32 formed on an elliptical virtual line adjacent to the predetermined elliptical virtual line. For example, a spaced space between the plurality of first cut patterns 30 formed on a specific elliptical virtual line is not in overlap with that between the plurality of second cut patterns 32 formed on an elliptical virtual line adjacent to the specific elliptical virtual line.

The number of cut patterns 30 and 32 formed on each elliptical virtual line may be the same. Although a case in which twelve cut patterns are formed on one elliptical virtual line is described as an example in this embodiment, the present invention is not limited thereto. For example, the random number of, preferably the even number of, more preferably four-fold number of cut patterns may be formed on each elliptical virtual line. As described above, since the number of cut patterns 30 and 32 is the same for each elliptical virtual line, and the plurality of elliptical virtual lines have a radial structure, a length of each of the cut patterns 30 and 32 may gradually increase in a direction from the center P to the edge, and a storage efficiency may increase.

Each elliptical virtual line may have the same number of cut patterns 30 and 32 within a predetermined angle range in a random direction based on the center P in order to uniformly distribute stress applied to the shopping bag 100 having the elliptical structure. For example, in case of FIG. 2, when a space is divided by an angle of 60° based on the center P, two first cut patterns 30 are formed for each elliptical virtual line in a randomly divided space. For example, in case of FIG. 3, when the space is divided by an angle of 60° with based on the center P, two second cut patterns 32 are formed for each elliptical virtual line in a randomly divided space.

Since the cut patterns 30 and 32 adjacent to the edge may be more vulnerable to stress as the length of each of the cut patterns 30 and 32 increases in the direction from the center P to the edge, the present invention may solve the above-described problem by allowing a distance between two adjacent elliptical virtual lines or a distance between the cut patterns 30 and 32 formed thereon to increase in the direction from the center P to the edge. The distance between the two adjacent elliptical virtual lines increases not only in a direction of a major axis but also in a direction of a minor axis. For example, in FIG. 2, when distances between two elliptical virtual lines adjacent in the direction of the major axis are D1, D2, . . . , D9 in the direction from the center P to the edge, the elliptical virtual lines or the cut patterns 30 and 32 are formed so that D1<D2< . . . <D9. Also, when distances between two elliptical virtual lines adjacent in the direction of the minor axis are L1, L2, . . . , L9 in the direction from the center P to the edge, the elliptical virtual lines or the cut patterns 30 and 32 are formed so that L1<L2< . . . <L9. Thus, the cut patterns 30 and 32 adjacent to the edge may have a stress carrying capacity greater than that of the cut patterns 30 and 32 adjacent to the center P.

Since the handle portion 40 is adjacent to the major axis LA of the peripheral portion 20, stress may be concentrated on the major axis LA. The present invention may solve the above-described problem by forming a distance between two predetermined adjacent elliptical virtual lines in a direction of the major axis LA to be greater than that in a direction of a minor axis SA. For example, in FIG. 2, D1>L1, D2>L2, . . . , D9>L9. Thus, since the distance between the cut patterns 30 and 32 adjacent in the direction of the major axis LA is greater than that between the cut patterns 30 and 32 adjacent in the direction of the minor axis SA, the peripheral portion 20 may have a high stress carrying capacity in the direction of the major axis LA.

As described above, since the distance between two predetermined adjacent elliptical virtual lines in the direction of the minor axis SA is less than that in the direction of the major axis LA, stress may be concentrated more in the direction of the minor axis SA. Thus, the present invention may solve the above-described problem by allowing a length of each of the plurality of cut patterns 30 and 32 formed on one elliptical virtual line to decrease in a direction from the major axis LA to the minor axis SA. Since a risk of breakage gradually decreases as the length of each of the cut patterns 30 and 32 decreases, the peripheral portion 20 may have a high stress carrying capacity in the direction of the minor axis SA.

As illustrated in FIG. 2, all of ends of the first cut patterns 30 formed on odd-numbered elliptical virtual lines are disposed on a predetermined linear line passing through the center P in order to uniformly distribute stress applied to the entire shopping bag 100 as the length of each of the cut patterns 30 and 32 increases in the direction from the center P to the edge. For example, all of both ends of the first cut pattern 30 formed on each of first, third, . . . , ninth elliptical virtual lines are disposed on a predetermined linear line passing through the center P. Similarly, as illustrated in FIG. 3, all of ends of the second cut patterns 32 formed on even-numbered elliptical virtual lines from the center P are disposed on a predetermined linear line passing through the center P. For example, all of both ends of the second cut pattern 32 formed on each of second, fourth, . . . , tenth elliptical virtual lines are disposed on a predetermined linear line passing through the center P.

The shopping bag 100 according to the present invention may be manufactured by using the same one flat material or a fiber fabric made of high-density polyethylene. Preferably, the flat material may be manufactured by using a spunbond olefin sheet made of high-density polyethylene. Here, the spunbond may be a form of nonwoven fabric made of spinning chemical fibers. The above-described flat material may not only have all excellent properties of paper, a film, and a fabric, but also eliminate the risk of breakage caused by asymmetric stress and the cut patterns 30 and 32 although manufactured with a small thickness. Furthermore, the flat material may be easily molded by Thomson processing.

FIG. 4 is a real photograph showing the shopping bag according to an embodiment of the present invention and illustrating a shape deformation when an object is stored.

Figure 5:
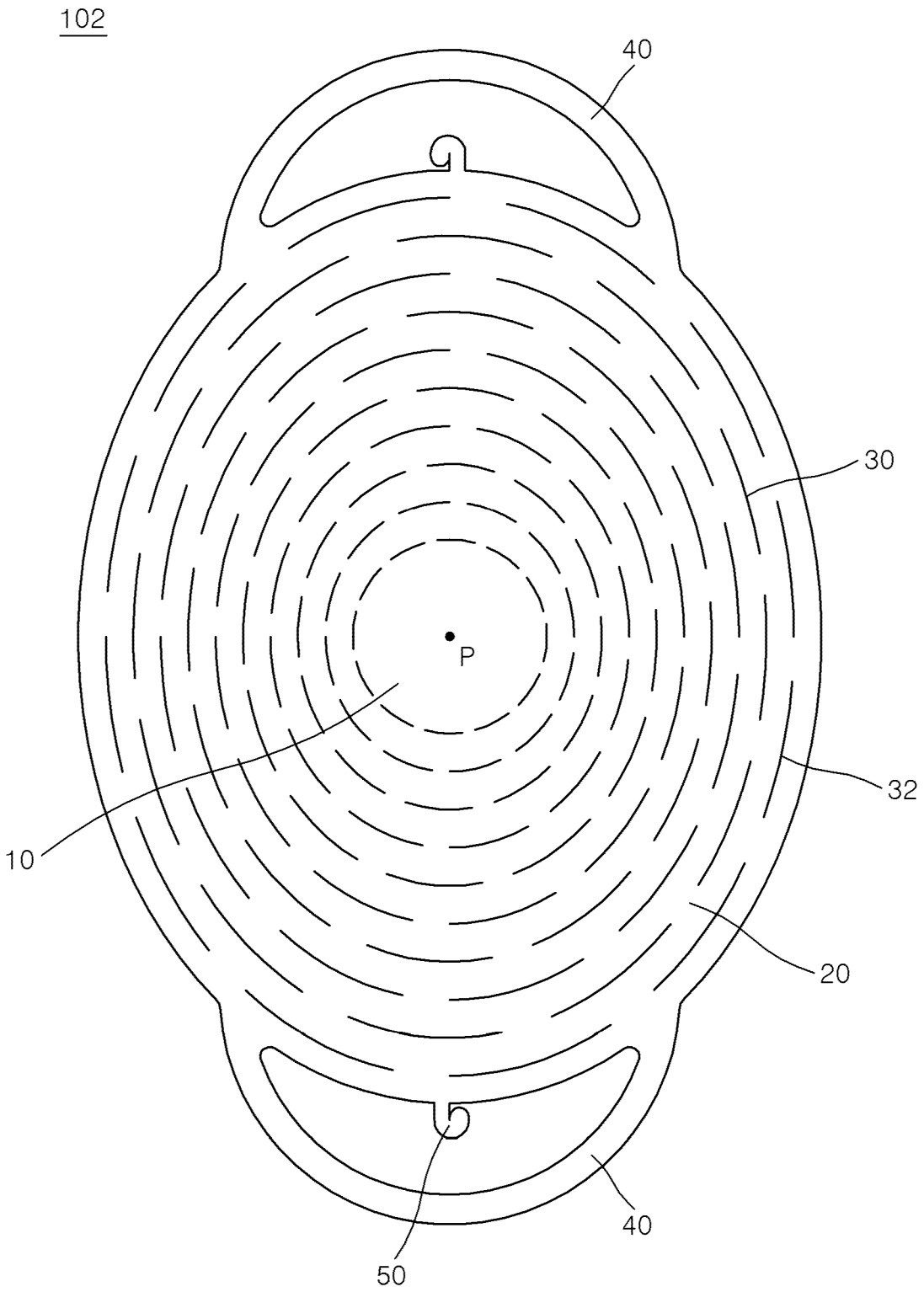
FIG. 5 is a front view illustrating a shopping bag according to another embodiment of the present invention.

Hereinafter, a shopping bag according to another embodiment of the present invention will be described in detail with reference to FIG. 5. FIG. 5 is a front view illustrating the shopping bag according to another embodiment of the present invention. For convenience of description, a member having the same function as the member illustrated in the drawings (FIGS. 1 to 4) according to the previous embodiment will be denoted by the same reference numerals, and a description thereof will be omitted. Hereinafter, different aspects will be mainly described.

A shopping bag 102 according to this embodiment includes a pair of hooks 50 formed at an edge of a peripheral portion 20 on a major axis LA. When an object is stored in the shopping bag 102, and then the pair of hooks 50 are coupled to each other, the stored object may be prevented from easily falling out of the shopping bag 102.

The description of the present invention is intended to be illustrative, and those with ordinary skill in the technical field of the present invention will be understood that the present invention can be carried out in other specific forms without changing the technical idea or essential features. Thus, the above-disclosed embodiments are to be considered illustrative and not restrictive.

The invention claimed is:

1. A shopping bag for storing an object, comprising:

a central portion on which the object is disposed;

a peripheral portion configured to surround the central portion; and a pair of handle portions symmetrically formed at both sides of an edge of the peripheral portion, wherein the edge of the peripheral portion has an elliptical shape, a plurality of elliptical virtual lines that are not in overlap with each other are provided in the peripheral portion, a plurality of cut patterns that are spaced apart from each other are formed on each of the elliptical virtual lines, and although the plurality of elliptical virtual lines have the same center, major axes of the plurality of elliptical virtual lines have different lengths, and minor axes of the plurality of elliptical virtual lines have different lengths, wherein a spaced space between the plurality of cut patterns formed on a predetermined elliptical virtual line is not in overlap with that between the plurality of cut patterns formed on an elliptical virtual line adjacent to the predetermined elliptical virtual line, the central portion has a circular shape, each of a length of the cut pattern and a distance between two adjacent elliptical virtual lines gradually increases in a direction from the center to the edge, a distance between two predetermined adjacent elliptical virtual lines in a direction of the major axis is greater than that in a direction of the minor axis, and the central portion, the peripheral portion, and the handle portions are formed on one flat material by Thomson processing.

2. The shopping bag of claim 1, wherein each elliptical virtual line comprises the same number of cut patterns within a predetermined angle range in a random direction based on the center, and a length of each of the plurality of cut patterns formed on one elliptical virtual line gradually decreases in a direction from a major axis to a minor axis.

3. The shopping bag of claim 1, wherein an end of the cut pattern formed on an odd-numbered elliptical virtual line from the center is disposed on a predetermined linear line passing through the center, and an end of the cut pattern formed on an even-numbered elliptical virtual line from the center is disposed on a predetermined linear line passing through the center.

4. The shopping bag of claim 1, wherein the handle portion is adjacent to the major axis of the peripheral portion, and a connection portion configured to connect an inside of the handle portion and the edge of the peripheral portion is rounded.

5. The shopping bag of claim 1, wherein the flat material is a spunbond olefin sheet made of high-density polyethylene.

* * * * *